US010648438B2

(12) United States Patent
Kochanowski et al.

(10) Patent No.: US 10,648,438 B2
(45) Date of Patent: May 12, 2020

(54) MULTIPART INSULATING ELEMENT, IN PARTICULAR FOR A FUEL INJECTION DEVICE

(71) Applicant: ROBERT BOSCH GMBH, Stuttgart (DE)

(72) Inventors: Martin Kochanowski, Moeglingen (DE); Thomas Froehner, Karlsruhe (DE); Markus Friedrich, Moosburg (DE); Martin Scheffel, Vaihingen (DE); Jason Kramer, Summerville, SC (US)

(73) Assignee: ROBERT BOSCH GMBH, Stuttgart (DE)

( * ) Notice: Subject to any disclaimer, the term of this patent is extended or adjusted under 35 U.S.C. 154(b) by 129 days.

(21) Appl. No.: 14/394,571

(22) PCT Filed: Mar. 22, 2013

(86) PCT No.: PCT/EP2013/056166
§ 371 (c)(1),
(2) Date: Oct. 15, 2014

(87) PCT Pub. No.: WO2013/156258
PCT Pub. Date: Oct. 24, 2013

(65) Prior Publication Data

US 2015/0059703 A1 Mar. 5, 2015

(30) Foreign Application Priority Data

Apr. 16, 2012 (DE) ..... 10 2012 206 194

(51) Int. Cl.
*F02M 61/14* (2006.01)

(52) U.S. Cl.
CPC ..... *F02M 61/14* (2013.01); *F02M 2200/03* (2013.01); *F02M 2200/09* (2013.01);
(Continued)

(58) Field of Classification Search
CPC ..... F02M 61/14; F02M 61/1886; F02M 2200/09; F02M 2200/30; F02M 2200/306;
(Continued)

(56) References Cited

U.S. PATENT DOCUMENTS 4,549,741 A * 10/1985 Usher ..... F16J 15/123 277/591
6,009,856 A 1/2000 Smith, III et al.
(Continued)

FOREIGN PATENT DOCUMENTS

CN 102245890 A 11/2011
DE 100 27 662 12/2001
(Continued)

OTHER PUBLICATIONS

English machine translation of EP 2405126 A1 provided by ESPACENET.*
(Continued)

*Primary Examiner* — Jacob M Amick
*Assistant Examiner* — Michael A Kessler
(74) *Attorney, Agent, or Firm* — Norton Rose Fulbright US LLP; Gerard Messina

(57) ABSTRACT

An insulating element for a fuel injection apparatus is notable in particular for the fact that a low-noise design is achieved. The fuel injection apparatus encompasses at least one fuel injection valve and one receiving bore in a cylinder head for the fuel injection valve, and the insulating element between a valve housing of the fuel injection valve and a wall of the receiving bore. The insulating element possesses an inner insulating ring that is present in encapsulated fashion between an outer ring and an inner ring. The outer ring is directed toward the fuel injection valve and the inner ring is directed toward the wall of the receiving bore, so that
(Continued)

corresponding abutment of these components occurs with the insulating element in the installed state. The fuel injection apparatus is suitable in particular for direct injection of fuel into a combustion chamber of a mixture-compressing spark-ignited internal combustion engine.

12 Claims, 4 Drawing Sheets

(52) U.S. Cl.
CPC . *F02M 2200/306* (2013.01); *F02M 2200/858* (2013.01); *F02M 2200/9023* (2013.01); *F02M 2200/9053* (2013.01)

(58) Field of Classification Search
CPC ..... F02M 2200/858; F02M 55/04; F02M 61/166; F02M 61/167; F02M 61/18–205; F02M 2200/16; F02M 2200/9015; F02M 2200/9023; F02M 2200/9046; F02M 2200/9053; F02M 55/0004; F16F 1/362; B32B 15/02
USPC ..... 123/470; 239/533.1, 533.11; 277/591–593
See application file for complete search history.

(56) References Cited

U.S. PATENT DOCUMENTS

| | | | | |
|---|---|---|---|---|
| 6,578,554 | B2 | 6/2003 | Schroeer | |
| 6,807,945 | B2 | 10/2004 | Reiter et al. | |
| 6,811,102 | B2 | 11/2004 | Krause et al. | |
| 6,899,087 | B2 | 5/2005 | Norgauer | |
| 7,261,246 | B2 | 8/2007 | Krause et al. | |
| 7,600,502 | B2 * | 10/2009 | Welzmueller | F02M 61/14 123/470 |
| 8,763,588 | B2 * | 7/2014 | Sugiyama | F02M 61/14 123/470 |
| 2011/0000464 | A1 | 1/2011 | Kannan et al. | |
| 2013/0014719 | A1 | 1/2013 | Sugiyama et al. | |

FOREIGN PATENT DOCUMENTS

| | | | | |
|---|---|---|---|---|
| DE | 100 38 763 | | 2/2002 | |
| DE | 101 08 466 | | 9/2002 | |
| DE | 10 2006 009 094 | | 8/2007 | |
| DE | 10 2008 048 173 | | 4/2010 | |
| DE | 102012013263 | A1 * | 1/2014 | F16F 1/362 |
| EP | 1 223 337 | | 7/2002 | |
| EP | 2405126 | A1 * | 1/2012 | F02M 61/14 |
| FR | 2335746 | A1 * | 7/1977 | F16F 1/362 |
| FR | 2954963 | A1 * | 7/2011 | F02M 61/14 |
| JP | 2010159726 | A | 7/2010 | |
| JP | WO 2012014326 | A1 * | 2/2012 | F02M 61/14 |
| WO | WO 2011/121728 | | 10/2011 | |
| WO | WO 2011121728 | A1 * | 10/2011 | F02M 61/14 |

OTHER PUBLICATIONS

English machine translation of WO 2012014326 A1 provided by ESPACENET.*
English Machine Translation of JP 2010159726 A, provided by ESPACENET.*
English Machine Translation of FR 2335746 A1 provided by ESPACENET (Year: 2019).*
International Search Report, PCT International Application No. PCT/EP2013/056166, dated May 31, 2013.

* cited by examiner

MULTIPART INSULATING ELEMENT, IN PARTICULAR FOR A FUEL INJECTION DEVICE

FIELD

The present invention proceeds from a multi-part insulating element, in particular for a fuel injection apparatus.

BACKGROUND INFORMATION

FIG. 1 shows an example of a conventional fuel injection apparatus, in which apparatus a flat intermediate element is provided on a fuel injection valve installed in a receiving bore of a cylinder head of an internal combustion engine. In conventional fashion, such intermediate elements are placed as bracing elements, in the form of a backing disk, on a shoulder of the receiving bore of the cylinder head. Such intermediate elements compensate for production and assembly tolerances and ensure mounting in a manner free of transverse forces even if the fuel injection valve is slightly oblique. The fuel injection apparatus is particularly suitable for use in fuel injection systems of mixture-compressing spark-ignited internal combustion engines.

Another type of simple intermediate element for a fuel injection apparatus is described in German Patent Application No. DE 101 08 466 A1. The intermediate element is a backing ring having a circular cross section, which is disposed in a region in which both the fuel injection valve and the wall of the receiving bore in the cylinder head proceed frustoconically, and serves as a compensating element for mounting and supporting the fuel injection valve.

More complex intermediate elements for fuel injection apparatuses, requiring appreciably more outlay for manufacture, are also known inter alia from German Patent Application Nos. DE 100 27 662 A1, DE 100 38 763 A1, and, European Patent No. EP 1 223 337 A1. These intermediate elements are notable for the fact that they are all constructed in multi-part or multiple-ply fashion, and are in part intended to perform sealing and damping functions. The intermediate element described in German Patent Application No. DE 100 27 662 A1 encompasses a base element and carrier element in which a sealing means is inserted, which means is penetrated by a nozzle body of the fuel injection valve. German Patent Application No. DE 100 38 763 A1 describes a multiple-ply compensating element that is made up of two stiff rings and an elastic intermediate ring disposed in sandwich fashion therebetween. This compensating element enables both tilting of the fuel injection valve with respect to the axis of the receiving bore over a relatively large angular range, and radial displacement of the fuel injection valve out of the center axis of the receiving bore.

A likewise multiple-ply intermediate element is also described in European Patent No. EP 1 223 337 A1, this intermediate element being made up of multiple backing disks that are made of a damping material. The damping material, made of metal, rubber, or PTFE, is selected and designed so as to enable acoustic damping of the vibrations and noise generated by operation of the fuel injection valve. The intermediate element must, however, encompass for that purpose four to six plies in order to achieve a desired damping effect.

In order to reduce noise emissions, U.S. Pat. No. 6,009,856 A furthermore proposes to surround the fuel injection valve with a sleeve and to fill up the resulting interstice with an elastic, acoustically damping compound. This type of acoustic damping is, however, very complex, difficult to assemble, and costly.

Also, as described in German Patent Application Nos. DE 10 2006 009 094 A1 and DE 10 2008 048 173 A1, decoupling or damping elements for fuel injection apparatuses are notable for the fact that they are embodied in multiple parts, an inner metal cushion being present as a braided, knitted, or woven wire element encapsulated in outer rings. An inner ring of the decoupling or damping element always comes into abutment against the fuel injection valve, while an outer ring of the decoupling or damping element abuts against a shoulder of a receiving bore of the cylinder head. The outer and inner ring are each simple sheet-metal rings, rectangular in cross section, having an L-shaped profile.

SUMMARY

An example insulating element in accordance with the present invention for a fuel injection apparatus may have the advantage that improved acoustic damping is achieved with a very simple design. In accordance with the present invention, the insulating element has a nonlinear, progressive spring characteristic curve that results in several positive and advantageous aspects when the insulating element is installed in a fuel injection apparatus having injectors for direct fuel injection.

The example insulating element in accordance with the present invention has the advantage that the bracing of the outer ring on the insulating ring reduces deflection of the outer ring with respect to the conventional approaches, and results in greater stiffness of the outer ring. A highly stiff outer ring in turn allows the spring characteristic curve to be designed solely by way of the insulating ring made of a wire braid having appreciably lower stiffness. The desired progressive spring characteristic curve (low stiffness at low operating pressures or loads, high stiffness at high system pressures) can thus ideally be generated in the combination of these two components. The stresses on weld seams possibly placed for securing purposes between the outer ring and insulating ring, or between the inner ring and insulating ring, can moreover be reduced. The overall flexural stress on the individual components of the multi-part insulating element is decreased.

The example multi-part insulating element according to the present invention produces an outstanding reduction in injector-caused noise during fuel injection, by decreasing energy transfer from the fuel injection valve to the cylinder head in the relevant frequency range. The elastic insulating element possesses both insulating and damping properties. Accurate positioning of the fuel injection valve with regard to the cylinder head, with very low tolerances and little stress on the valve seals (with respect to the combustion chamber and to the fuel rail), is made possible. The insulating element permits repeatable elastic deformation of the insulating element over the entire injector service life with no occurrence of plastic deformations. The insulating system enables a maximization of the insulating function while limiting injector movement.

Advantageously, the spring characteristic curve of the insulating element according to the present invention can be progressively designed in controlled fashion by adapting the geometric parameters of, in particular, the insulating ring.

BRIEF DESCRIPTION OF THE DRAWINGS

Exemplifying embodiments of the present invention are depicted in simplified fashion in the figures and described below.

DETAILED DESCRIPTION OF EXAMPLE EMBODIMENTS

Figure 1:
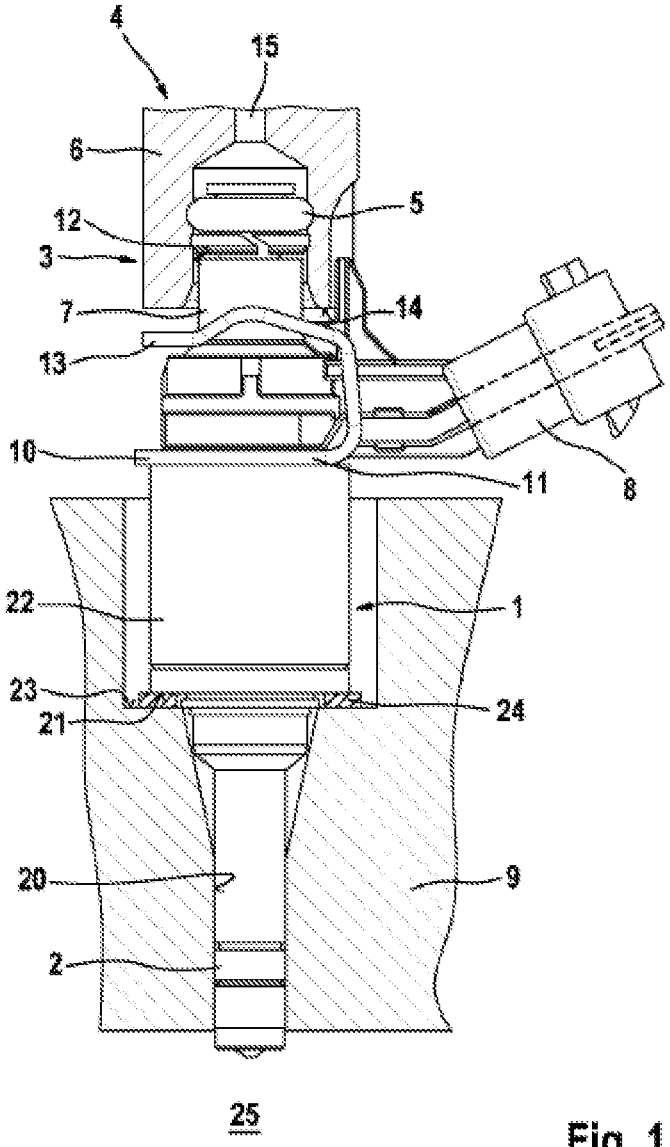
Fig. 1 (related art)
FIG. 1 shows a partly depicted fuel injection apparatus in a conventional embodiment, having a disk-shaped intermediate element.

A conventional embodiment of a fuel injection apparatus is described in more detail below with reference to FIG. 1 in order to elucidate the invention. FIG. 1 depicts in a side view, as an exemplifying embodiment, a valve in the form of an injection valve 1 for fuel injection systems of mixture-compressing spark-ignited internal combustion engines. Fuel injection valve 1 is part of the fuel injection apparatus. Fuel injection valve 1, which is embodied in the form of a direct-injecting injection valve for direct injection of fuel into a combustion chamber 25 of the internal combustion engine, is installed with a downstream end into a receiving bore 20 of a cylinder head 9. A sealing ring 2, made in particular of Teflon®, ensures optimum sealing of fuel injection valve 1 with respect to the wall of receiving bore 20 of cylinder head 9.

A flat intermediate element 24, which is embodied as a bracing element in the form of a backing disk, is placed between a setback 21 of a valve housing 22 and a shoulder 23, extending e.g. at right angles to the longitudinal extension of receiving bore 20, of receiving bore 20. An intermediate element 24 of this kind compensates for production and assembly tolerances and ensures mounting in a manner free of transverse forces even if fuel injection valve 1 is slightly oblique.

Fuel injection valve 1 has at its inflow end 3 a plug connection to a fuel distribution line (fuel rail) 4 which is sealed by a sealing ring 5 between a connector fitting 6 of fuel distributor line 4, which is depicted in section, and an inlet fitting 7 of fuel injection valve 1. Fuel injection valve 1 is inserted into a receiving opening 12 of connector fitting 6 of fuel distribution line 4. Connector fitting 6 proceeds, e.g., integrally out of the actual fuel distributor line 4 and possesses, upstream from receiving opening 12, a smaller-diameter flow opening 15 through which flow occurs into fuel injection valve 1. Fuel injection valve 1 possesses an electrical connector plug 8 for electrical contacting in order to actuate fuel injection valve 1.

A holddown 10 is provided between fuel injection valve 1 and connector fitting 6 in order to space fuel injection valve 1 and fuel distributor line 4 away from one another largely without radial forces, and to hold fuel injection valve 1 securely down in the receiving bore of the cylinder head. Holddown 10 is embodied as a bracket-shaped component, e.g., as a stamped and bent part. Holddown 10 has a partially annular base element 11 from which a holddown bracket 13, which in the installed state abuts against a downstream end surface 14 of connector fitting 6 on fuel distributor line 4, proceeds out in bent fashion.

An object of the present invention is to achieve improved acoustic damping as compared with the conventional intermediate-element approaches in simple fashion by way of a targeted design and geometry of intermediate element 24, above all in the acoustically critical idle mode. The noise source of fuel injection valve 1 in a context of direct high-pressure injection is the forces introduced into cylinder head 9 during valve operation (solid-borne sound), which result in a structural excitation of cylinder head 9 and are radiated therefrom as airborne sound. In order to achieve an acoustic improvement, a minimization of the forces introduced into cylinder head 9 is therefore desirable. In addition to decreasing the forces caused by injection, this can be achieved by influencing the transfer behavior between fuel injection valve 1 and cylinder head 9.

Figure 2:
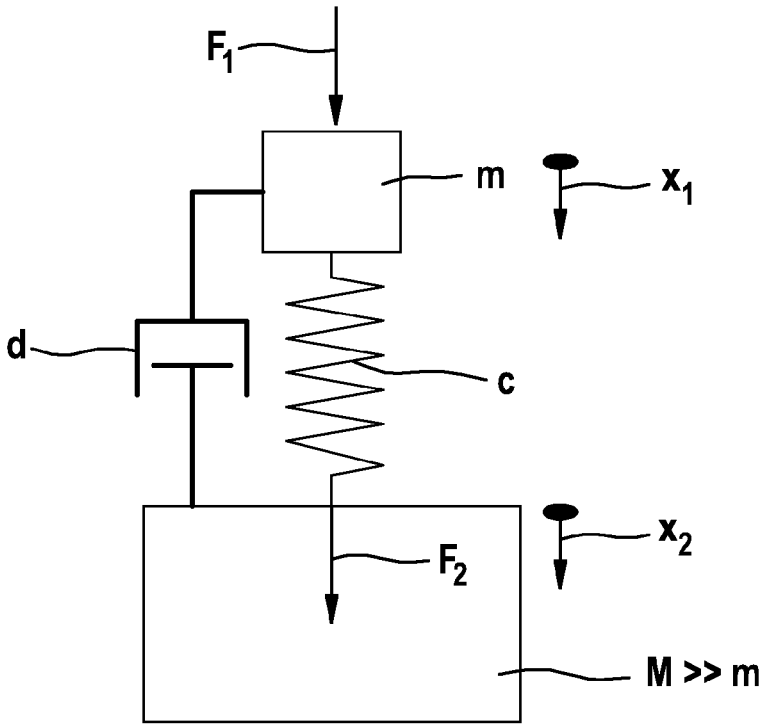
FIG. 2 is a mechanical equivalent diagram of the bracing of the fuel injection valve in the cylinder head in a context of direct fuel injection, the diagram reproducing a usual spring-mass damper system.
Figure 3:
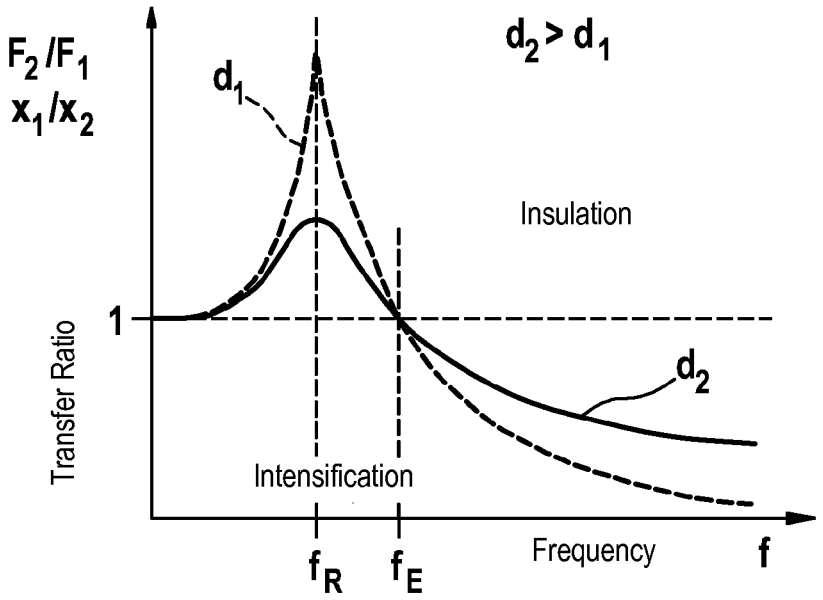
FIG. 3 shows the transfer behavior of a spring-mass damper system shown in FIG. 2 with an intensification at low frequencies in the range of the resonant frequency $f_R$ and in an insulating region above the decoupling frequency $f_E$.

In mechanical terms, the mounting of fuel injection valve 1 on the passive intermediate element 24 in receiving bore 20 of cylinder head 9 can be represented as a usual spring-mass damper system, as depicted in FIG. 2. The mass M of cylinder head 9 can be assumed, to a first approximation, to be infinitely large as compared with the mass m of fuel injection valve 1. The transfer behavior of such a system is notable for an intensification at low frequencies in the region of the resonant frequency $f_R$, and an insulating region above the decoupling frequency $f_E$ (see FIG. 3).

An objective of the present invention is to provide an intermediate element 24 using principally elastic insulation (decoupling) to decrease noise, in particular with the vehicle at idle. The present invention encompasses on the one hand the definition and design of a suitable spring characteristic curve in consideration of typical requirements and boundary conditions in direct fuel injection with variable operating pressure, and on the other hand the design of an intermediate element 24 that is capable of reproducing the characteristics of the spring characteristic curve thus defined, and can be adapted, by the selection of simple geometric parameters, to the specific boundary conditions of the injection system.

Decoupling of fuel injection valve 1 from cylinder head 9 with the aid of a low spring stiffness c of the multi-part insulating element 30 according to the present invention is made difficult not only by the small installation space but also by a limitation on the maximum permissible movement of fuel injection valve 1 during engine operation. As may be gathered from FIG. 4, the following quasi-steady-state load conditions typically occur in the vehicle:

1. the steady-state holddown force $F_{NH}$ applied after assembly by a holddown 10,
2. the force $F_L$ existing at idle operating pressure, and
3. the force $F_{Sys}$ existing at nominal system pressure.

Usual bracing elements constituting intermediate elements 24 possess a linear spring characteristic curve in the energy region discussed. The result of this is that the stiffness of intermediate element 24 at the desired decoupling point at idle must be based on the above-defined maximum permissible movement of fuel injection valve 1, and is too great for effective decoupling. Because nominal operating pressures will probably rise further in the future, this problem will become more acute.

Figure 4:
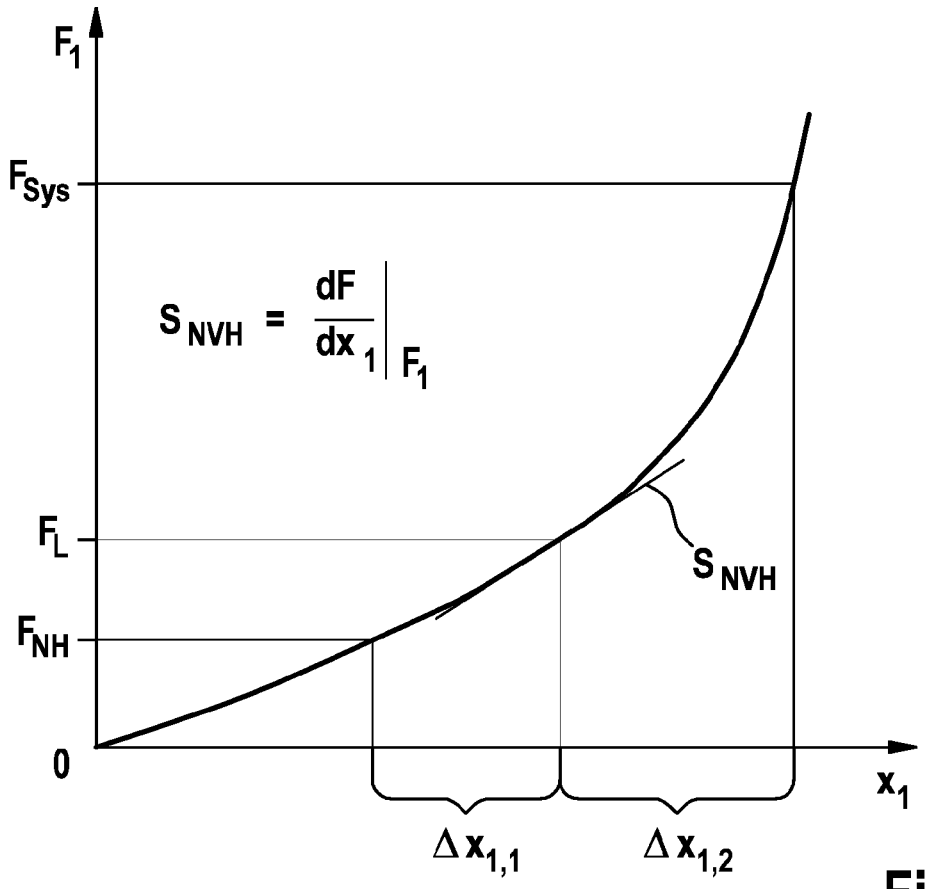
FIG. 4 shows a nonlinear progressive spring characteristic curve for implementing different stiffness values as a function of the working point, with a low stiffness $S_{NVH}$ at idle and a high stiffness at nominal system pressure $F_{Sys}$.

In order to resolve this conflict, according to the present invention a nonlinear spring characteristic curve having a progressive profile is proposed for insulating element 30, as sketched in FIG. 4. The characteristic of this spring characteristic curve enables acoustic decoupling with the aid of a low spring stiffness ($S_{NVH}$) at idle, and thanks to the rapidly rising stiffness allows conformity with the maximum movement of fuel injection valve 1 between idle pressure and system pressure.

To allow optimum implementation of the nonlinear spring characteristic curve under typical boundary conditions of direct fuel injection (little installation space, large forces, little total movement of fuel injection valve 1), according to the present invention insulating element 30 is constructed in multiple parts from an outer ring 31, an inner ring 32, and an insulating ring 33, such that insulating ring 33 proceeds circumferentially, surrounded in encapsulated fashion by inner ring and 32 and outer ring 31. It thus differs appreciably from conventional cup springs, which in principle exhibit initially only a linear or degressive characteristic curve shape. With conventional cup springs a progressive curve is not achieved until they are loaded almost completely to "blocking."

Figure 5:
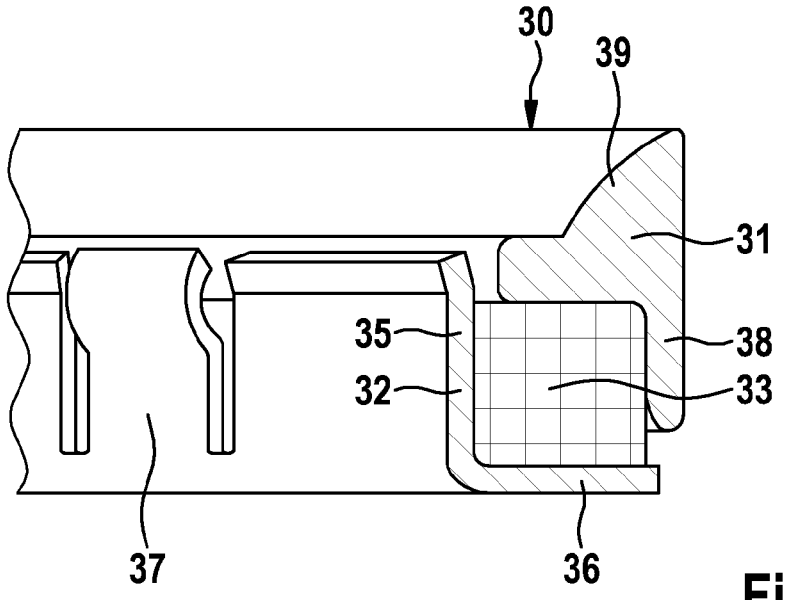
FIG. 5 is a partial cross section through a multi-part insulating element according to an example embodiment of the present invention that is usable in a fuel injection apparatus.

FIG. 5 is a partial cross section through a multi-part insulating element 30 according to the present invention that is usable in a fuel injection apparatus. The multi-part insulating element 30 has two functional units. The first functional unit is constituted by insulating ring 33. Insulating ring 33 is an annular braided, knitted, or woven wire element that, individually, performs two functions according to the present invention. The primary function, as already described in detail previously, may achieve optimum insulation (decoupling) at the fuel injection apparatus by way of a progressive spring characteristic curve having low stiffness under low load conditions (e.g., idle, noise-critical operating regions), and high stiffness at nominal system pressure. What is desired as a secondary function of insulating ring 33 is damping (which is not to be equated with insulation, since different physical mechanisms of action exist), which is implemented by way of an internal friction of the wire braid of insulating ring 33 during injection in a context of micromovements of fuel injection valve 1. The braided, knitted, or woven wire element of insulating ring 33 has, for example, a largely square cross section.

The second functional unit is constituted by outer ring 31 and inner ring 32, which together form an annular chamber for insulating ring 33 and in that regard encapsulate it. Inner ring 32 is thin-walled, e.g., embodied as a sheet-metal part, and possesses on an inner side 35 an annular-disk-shaped surface and on its underside 36 a cylinder-head-side bracing surface. The two sides 35, 36 proceed largely perpendicularly to one another. Inner side 35 can have elastic elements 37 distributed over the circumference which are embodied, for example, like spring clips and ensure that insulating element 30 is fastened in lossproof fashion on fuel injection valve 1. Outer ring 31 has a greater material thickness than inner ring 32. Outer ring 31 possesses on an outer side 38 an annular-disk-shaped surface, while on its upper side 39, of thick and stable conformation, an injector-side bracing surface is provided which extends in crowned or spherical and convexly bulging fashion. Insulating element 30 abuts with this bracing surface of upper side 39 against a, for example, conically extending shoulder of valve housing 22, so that (viewed ideally) only a linear contact occurs here between the corresponding component partners 1, 30.

Figure 6:
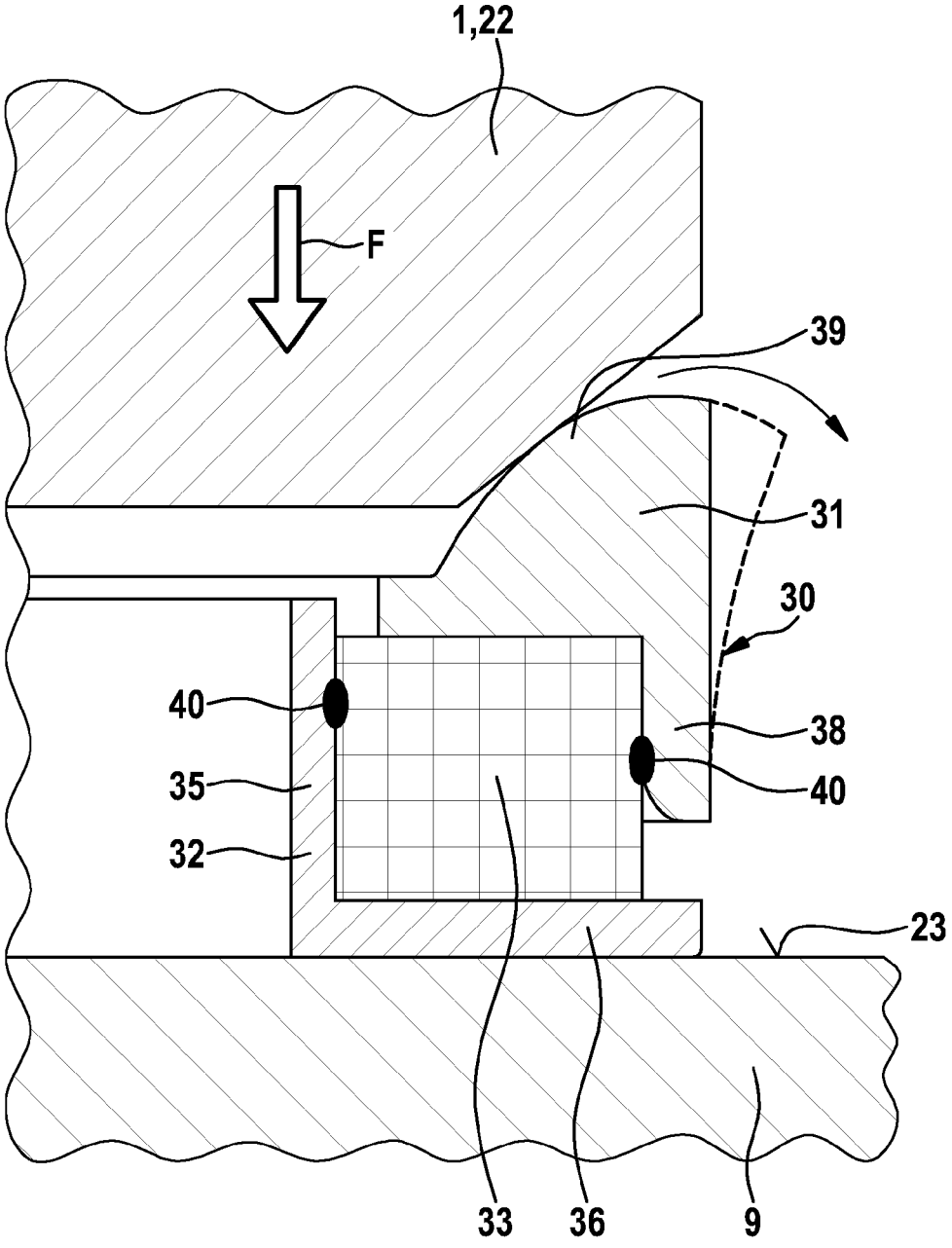
FIG. 6 is a partial cross section through an example insulating element according to the present invention in an installed situation on a fuel injection valve in the region of the disk-shaped intermediate element shown in FIG. 1.

FIG. 6 is a partial cross section through an insulating element 30 according to the present invention in an installed situation on a fuel injection valve 1 in the region of the disk-shaped intermediate element 24 shown in FIG. 1. As indicated in FIG. 6 exaggeratedly with the curved arrow, and with the dashed-line deflection and warping (not to scale) of outer ring 31, insulating element 30 according to the present invention has the advantage that the bracing of outer ring 31 on insulating ring 33 reduces the deflection of outer ring 31 as compared with conventional approaches, and results in greater stiffness of outer ring 31. A highly stiff outer ring 31 in turn allows the spring characteristic curve to be designed solely by way of insulating ring 33, made up of the braided wire having appreciably lower stiffness. The desired progressive spring characteristic curve can thus ideally be produced by the combination of these two components 31, 33. The stresses on weld seams 40 possibly placed for securing purposes between outer ring 31 and insulating ring 33, or between inner ring 32 and insulating ring 33, can moreover be reduced. The requirements to be imposed on weld seams 40 are thus lower. The overall flexural stress on the individual components of the multi-part insulating element 30 is decreased.

An outstanding reduction in injector-caused noise during fuel injection is achieved with the multi-part insulating element 30 in accordance with the present invention, by decreasing energy transfer from fuel injection valve 1 to cylinder head 9 in the relevant frequency range. The elastic insulating element 30 possesses both insulating and damping properties. Accurate positioning of fuel injection valve 1 with respect to cylinder head 9 with very low tolerances and little stress on the valve seals (with respect to combustion chamber 25 and to fuel rail 4) is made possible. Insulating element 30 permits repeatable elastic deformation of insulating element 30 over the entire injector service life with no occurrence of plastic deformations. The insulating system enables a maximization of the insulating function while limiting injector movement.

What is claimed is:

1. A multi-part insulating element for a fuel injection apparatus for a fuel injection system of an internal combustion engine for direct injection of fuel into a combustion chamber, the fuel injection apparatus comprising:

at least one fuel injection valve and one receiving bore for the fuel injection valve; and an insulating element introduced between a valve housing of the fuel injection valve and a wall of the receiving bore, the insulating element including an inner insulating ring that is circumferentially surrounded by an outer ring and an inner ring, the outer ring being directed toward the fuel injection valve and the inner ring being directed toward the wall of the receiving bore, wherein abutment of the outer ring and the fuel injection valve occurs with the insulating element, the inner ring, and the wall of the receiving bore in an installed state, wherein the outer ring is disposed on a top surface of the insulating ring, wherein the insulating ring is an annular braided, knitted, or woven wire element, wherein the inner ring includes a first side, wherein the outer ring includes a second side that faces the first side, wherein the annular braided, knitted, or woven wire element directly contacts the first side of the inner ring and directly contacts the second side of the outer ring, wherein an entire length of the first side directly contacts only a material of the annular braided, knitted, or woven wire element, and wherein an entire length of the second side directly contacts only the material of the annular braided, knitted, or woven wire element.

2. The insulating element as recited in claim 1, wherein the inner ring is embodied in thin-walled fashion and has an annular-disk-shaped surface on an inner side and a flat bracing surface on an underside.

3. The insulating element as recited in claim 2, wherein the inner side of the inner ring includes elastic elements.

4. The insulating element as recited in claim 3, wherein the elastic elements are spring clips.

5. The insulating element as recited in claim 1, wherein at least one weld seam placed for securing purposes is provided at least one of: i) between the outer ring and insulating ring, and ii) between the inner ring and insulating ring.

6. The insulating element as recited in claim 1, wherein the receiving bore for the fuel injection valve is in a cylinder head, and the receiving bore has a shoulder that proceeds perpendicularly to the extent of the receiving bore and abuts on the inner ring.

7. The insulating element as recited in claim 1, wherein the valve housing of the fuel injection valve is equipped, in an abutment region of the insulating element, with a conical outer contour against which the outer ring braces.

8. The insulating element as recited in claim 1, wherein:

the outer ring has an annular-disk-shaped surface on an outer side, and an injector-side bracing surface on an upper side, the injector-side bracing surface of the upper side includes a curved, convexly bulging surface that in the installed state extends toward and contacts the fuel injection valve, and the curved, convexly bulging surface is a single, continuous arcuate surface.

9. The insulating element as recited in claim 1, wherein the outer ring has an annular-disk-shaped surface on an outer side that radially surrounds the inner insulating ring.

10. The insulating element as recited in claim 8, wherein the annular-disk-shaped surface on the outer side radially surrounds the inner insulating ring.

11. The insulating element as recited in claim 1, wherein the insulating ring has a square cross-section.

12. The insulating element as recited in claim 11, wherein:

the first side and the second sides are planar surfaces, and the first side and the second side lie flush against respective planar surfaces of the insulating ring.

* * * * *